US006554213B2

(12) United States Patent
Chen

(10) Patent No.: US 6,554,213 B2
(45) Date of Patent: Apr. 29, 2003

(54) SPRINKLING NOZZLE HAVING A PLIABLE BARREL

(75) Inventor: Chin-Yuan Chen, Chang-Hua Hsien (TW)

(73) Assignee: Shin Tai Spurt Water of the Garden Tools Co., Ltd., Chang-Hua Hsien (TW)

( * ) Notice: Subject to any disclaimer, the term of this patent is extended or adjusted under 35 U.S.C. 154(b) by 62 days.

(21) Appl. No.: 09/903,908

(22) Filed: Jul. 13, 2001

(65) Prior Publication Data

US 2003/0010851 A1 Jan. 16, 2003

(51) Int. Cl.[7] ..... A62C 31/02
(52) U.S. Cl. ..... 239/394; 239/532; 239/437
(58) Field of Search ..... 239/390–394, 239/396, 436, 437, 442, 548, 532, 588

(56) References Cited

U.S. PATENT DOCUMENTS

| | | | | |
|---|---|---|---|---|
| 5,823,442 A | * | 10/1998 | Guo | 239/394 |
| 6,164,566 A | * | 12/2000 | Hui-Chen | 239/394 |
| 6,230,988 B1 | * | 5/2001 | Chao | 239/394 |
| 6,341,737 B1 | * | 1/2002 | Chang | 239/394 |
| 6,481,643 B1 | * | 11/2002 | Chen | 239/390 |

* cited by examiner

*Primary Examiner*—Lisa A. Douglas
(74) *Attorney, Agent, or Firm*—Harrison & Egbert

(57) ABSTRACT

A sprinkling nozzle structure a fixation body, a hose connecting body, a hand grip, a spout member, and a barrel member. The hose connecting body is fastened to one end of the fixation body. The fixation body is fastened at the other end to the barrel member which is in turn fastened to the spout member. The barrel member is pliable to facilitate the directing of the spout member at a hard-to-reach area which is intended to be washed.

2 Claims, 6 Drawing Sheets

SPRINKLING NOZZLE HAVING A PLIABLE BARREL

BACKGROUND OF THE INVENTION

1. Field of the Invention

The present invention relates generally to a sprinkling system, and more particularly to a sprinkling nozzle having a pliable barrel to facilitate the directing of the nozzle.

2. Description of Related Art

The conventional sprinkling nozzle comprises a barrel and a spout which is fastened to one end of the barrel for discharging a liquid. The barrel is fastened at the other end to a hose. The barrel is so rigid that it cannot be bent to facilitate the spout to reach a hard-to-reach area, thereby subjecting the user of the conventional sprinkling nozzle to maneuver in various ways to reach the hard-to-reach area at the risk of injury.

BRIEF SUMMARY OF THE INVENTION

The primary objective of the present invention is to provide a sprinkling nozzle which is free of the shortcoming of the conventional sprinkling nozzle described above.

The features, functions, and advantages of the present invention will be readily understood upon a thoughtful deliberation of the following detailed description of a preferred embodiment of the present invention with reference to the accompanying drawings.

DETAILED DESCRIPTION OF THE INVENTION

Figure 1:
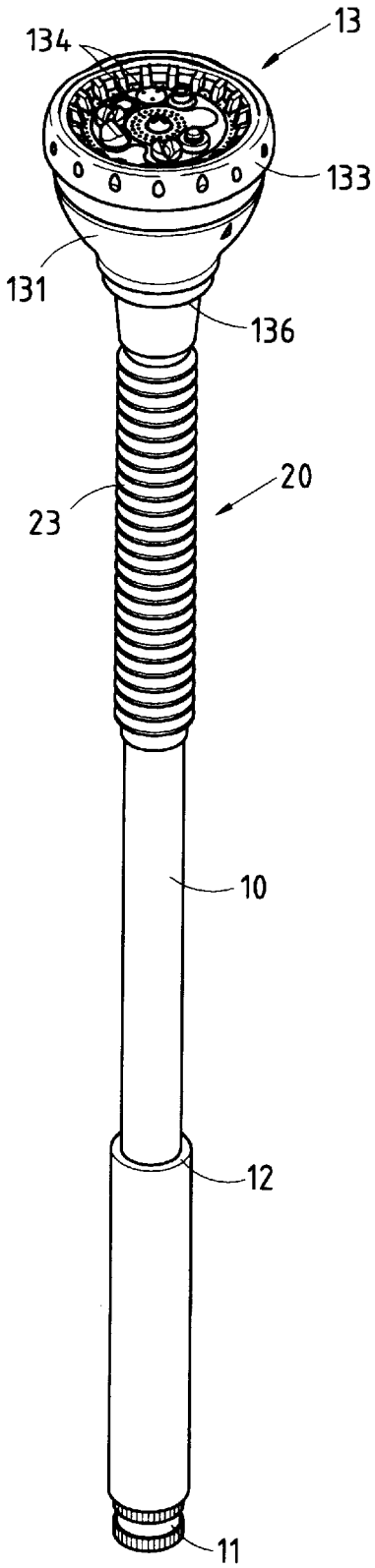
FIG. 1 shows a perspective view of the preferred embodiment of the present invention.
Figure 2:
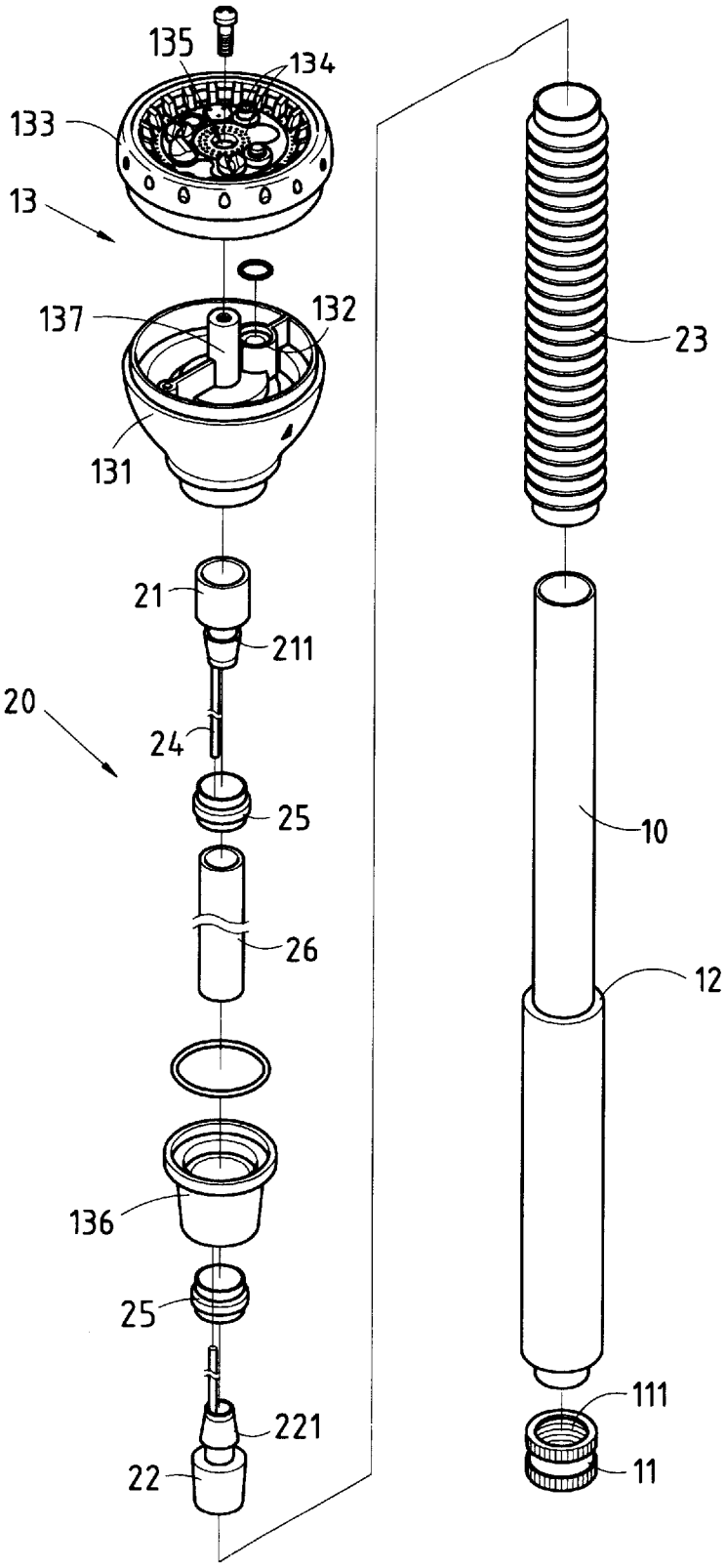
FIG. 2 shows an exploded view of the preferred embodiment of the present invention.
Figure 3:
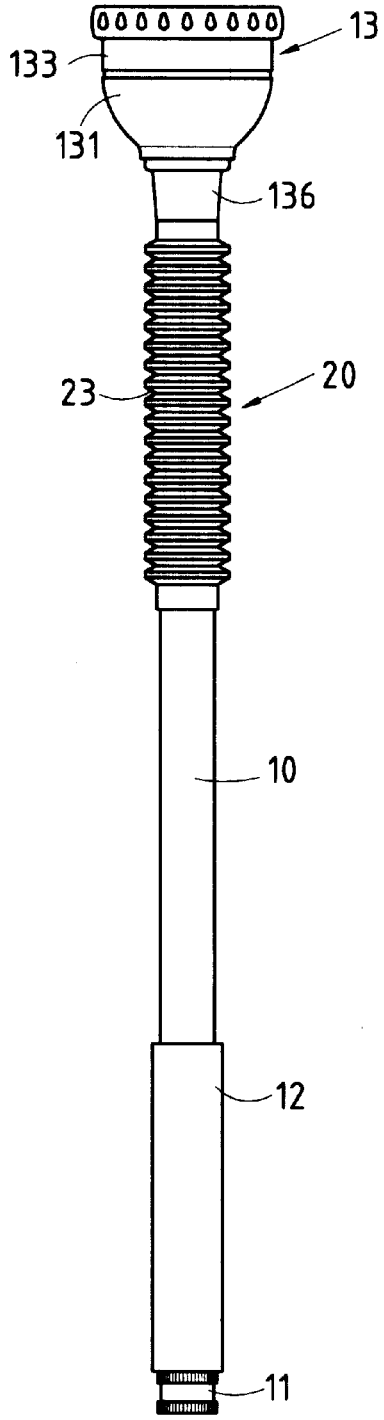
FIG. 3 shows a side schematic view of the preferred embodiment of the present invention.
Figure 4:
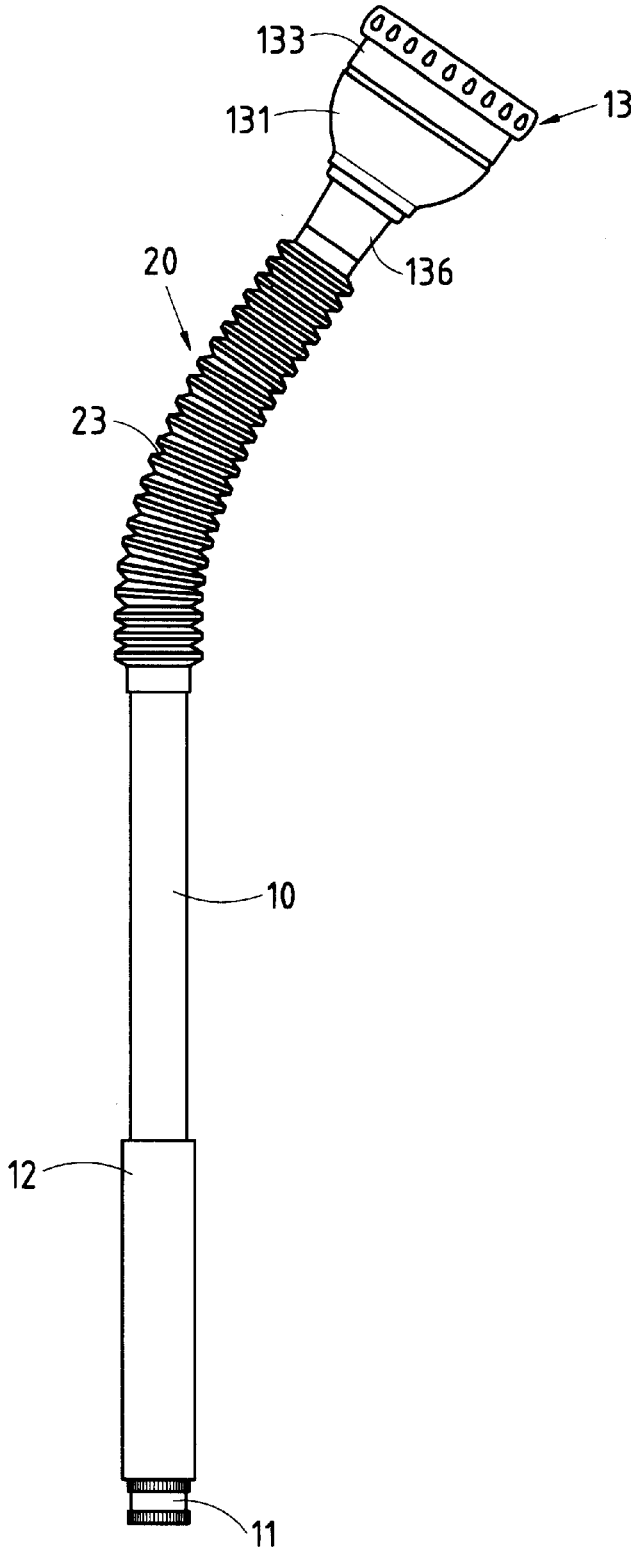
FIG. 4 shows a side schematic view of the preferred embodiment of the present invention in action.
Figure 5:
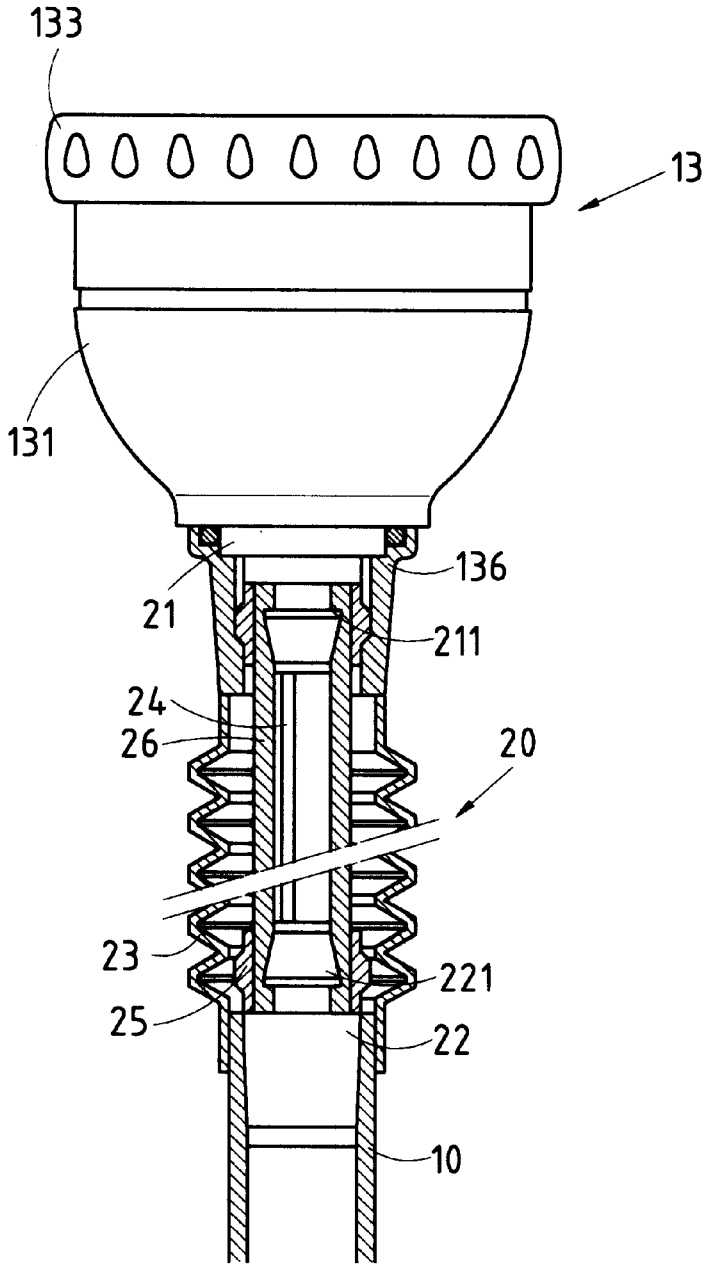
FIG. 5 shows a partial longitudinal sectional view of the preferred embodiment of the present invention as shown in FIG. 3.
Figure 6:
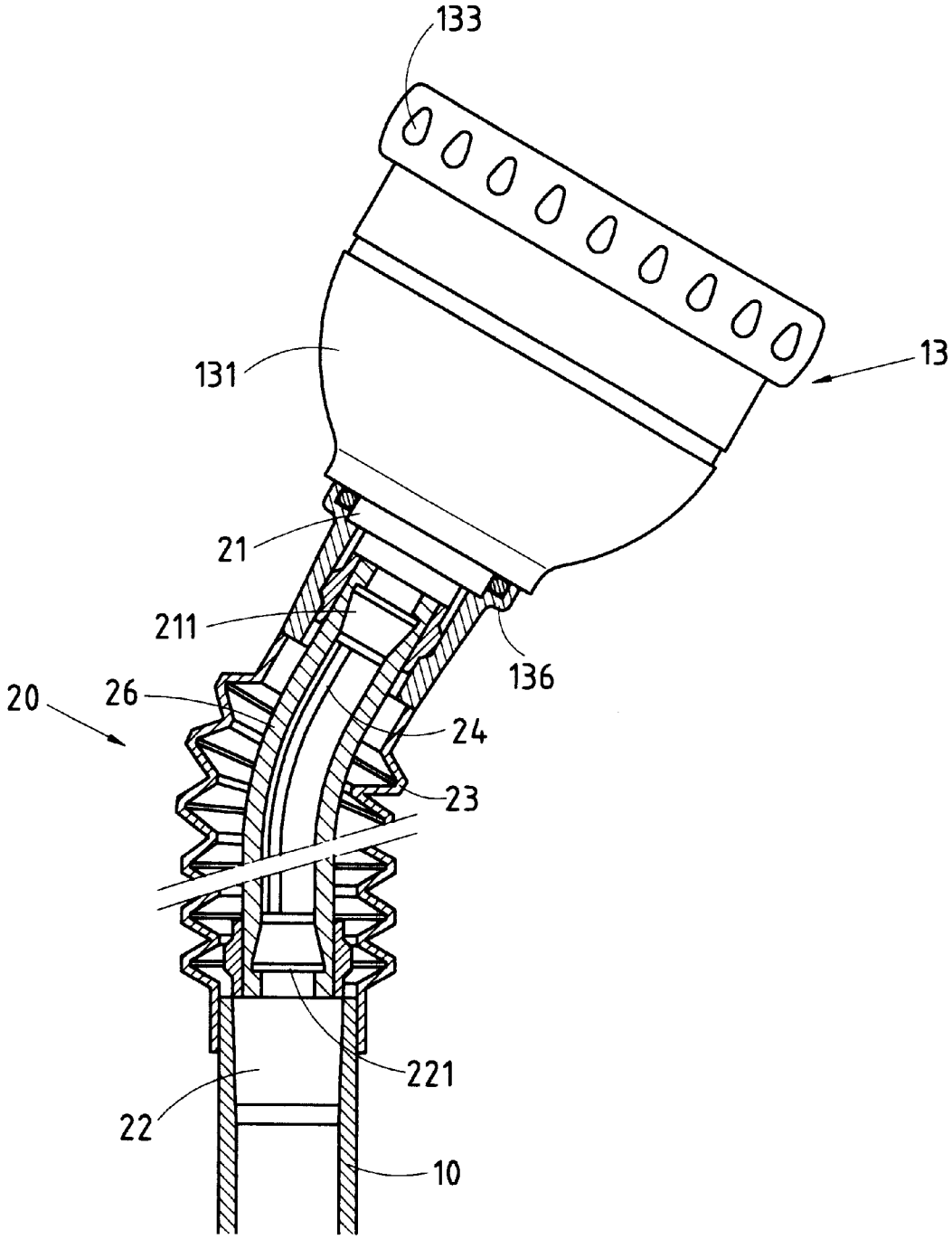
FIG. 6 shows a partial longitudinal sectional view of the preferred embodiment of the present invention as shown in FIG. 4.

As shown in FIGS. 1–6, a sprinkling nozzle of the preferred embodiment of the present invention comprises a fixation body 10, a hose connecting body 11, a hand grip 12, a spout member 13, and a barrel member 20.

The fixation body 10 is fastened at one end to the hose connecting body 11, and at the other end to the barrel member 20. The hand grip 12 is fitted over the fixation body 10. The hose connecting body 11 is provided at one end with inner threads 111 which are engaged with the one end of the fixation body 10. The hose connecting body 11 is connected at the other end with a hose (not shown in the drawings).

The spout number 13 is formed of a bottom body 131 which is provided in the interior with a water guiding tube 132, a top body 133 which is provided with a plurality of water discharging holes 134 and a fastening hole 135, and a disposition member 136 fitted over the bottom of the bottom body 131.

The barrel member 20 is formed of an inner tube 21 having an inverted hooked structure 211, and a pliable metal body 24 which is fastened at the other end to another inner tube 22 having an inverted hooked structure 221. An inner guide tube 26 is joined with the inverted hooked structures 211 and 221 in conjunction with an annular fitting member 25. A pliable outer tube 23 is fastened at one end to the fixation body 10 and at the other end to the spout member 13.

The bottom body 131 and the top body 133 of the spout member 13 are joined together by a joining rod 137 which is received in the fastening hole 135 of the top body 133.

In light of the outer tube 23 and the metal body 24 being pliable, the barrel member 20 can be elastically deformed to allow the spout member 13 to be directed at a hard-to-reach area to facilitate the washing of the hard-to-reach area.

The preferred embodiment of the present invention described above is to be regarded in all respects as being illustrative and not restrictive. Accordingly, the present invention may be embodied in other specific forms without deviating from the spirit thereof. The present invention is therefore to be limited only by the scope of the following claims.

I claim:

1. A sprinkling nozzle structure comprising:

a fixation body fastened at one end to a hose connecting body, and at another end to a barrel member, said fixation body comprised of a hand grip fitted thereover, said hose connecting body provided at one end with a plurality of inner threads which are engaged with the one end of said fixation body, said hose connecting body being connected at another end to a hose;

a spout member comprised of a bottom body which is provided in an interior with a water guiding tube, a top body which is provided with a plurality of water discharging holes and a fastening hole, said bottom body being provided with a disposition member fitted over a bottom of said bottom body; and a barrel member comprised of an inner tube having a first inverted hooked structure, and a pliable metal body which is fastened at another end to another inner tube having a second inverted hooked structure, said first inverted hooked structure and said second inverted hooked structure being joined with an inner guide tube in conjunction with an annular fitting member, a pliable outer tube being fastened at one end to said fixation body and at another end to said spout member.

2. The sprinkling nozzle structure as defined in claim 1, wherein said bottom body and said top body of said spout member are joined together by a joining rod which is received in said fastening hole of said top body.

* * * * *